US005361951A

United States Patent [19]

Chehebar

[11] Patent Number: 5,361,951

[45] Date of Patent: Nov. 8, 1994

[54] REVERSIBLE BACKPACK ASSEMBLY

[76] Inventor: Joey Chehebar, 1778 E. 9th St., New York, N.Y. 10001

[21] Appl. No.: 156,467

[22] Filed: Nov. 23, 1993

[51] Int. Cl.[5] ..... A45F 3/00

[52] U.S. Cl. ..... 224/153; 224/209; 150/103

[58] Field of Search ..... 224/151, 153, 202, 205, 224/209, 257-259; 150/103, 117; 383/6, 38-41

[56] References Cited

U.S. PATENT DOCUMENTS

| | | | |
|---|---|---|---|
| 2,086,326 | 7/1937 | Goldberg | 2/66 |
| 2,635,664 | 4/1953 | Cohen | 150/103 |
| 3,108,627 | 10/1963 | Tatelman | 150/117 X |
| 3,173,465 | 3/1965 | Pastini | 150/117 X |
| 3,346,155 | 10/1967 | Oechsle | 224/205 |
| 3,550,663 | 12/1970 | Johnston | 150/103 |
| 3,847,194 | 11/1974 | Corigliano | 150/103 |
| 4,182,391 | 1/1980 | Kjose | 224/202 |
| 4,213,549 | 7/1980 | Hibbard | 224/209 |
| 4,273,274 | 6/1981 | Freistadt | 224/153 X |
| 4,301,849 | 11/1981 | Litwack et al. | 150/103 |
| 4,774,734 | 10/1988 | Mills | 224/156 X |
| 5,101,974 | 4/1992 | Alwitt | 224/207 X |
| 5,152,612 | 10/1992 | Shoemaker | 383/6 |

FOREIGN PATENT DOCUMENTS

| | | | |
|---|---|---|---|
| 0480573 | 4/1992 | European Pat. Off. | 224/205 |
| 1363571 | 5/1964 | France | 150/103 |

*Primary Examiner*—J. Casimer Jacyna
*Attorney, Agent, or Firm*—Jeffrey M. Kaden

[57] ABSTRACT

A reversible backpack assembly is provided. The backpack assembly of the invention comprises a bag having an opening to enable access to its interior and a side or rear panel to which a strap assembly is connected. The strap assembly is used by the backpack wearer for carrying the bag along the wearer's back and includes a pair of supporting shoulder straps having ends connected to the bag panel and ends which may be selectively coupled to a corresponding pair of strap connectors fixed to the outside and inside of the bag.

10 Claims, 2 Drawing Sheets

FIG. 1
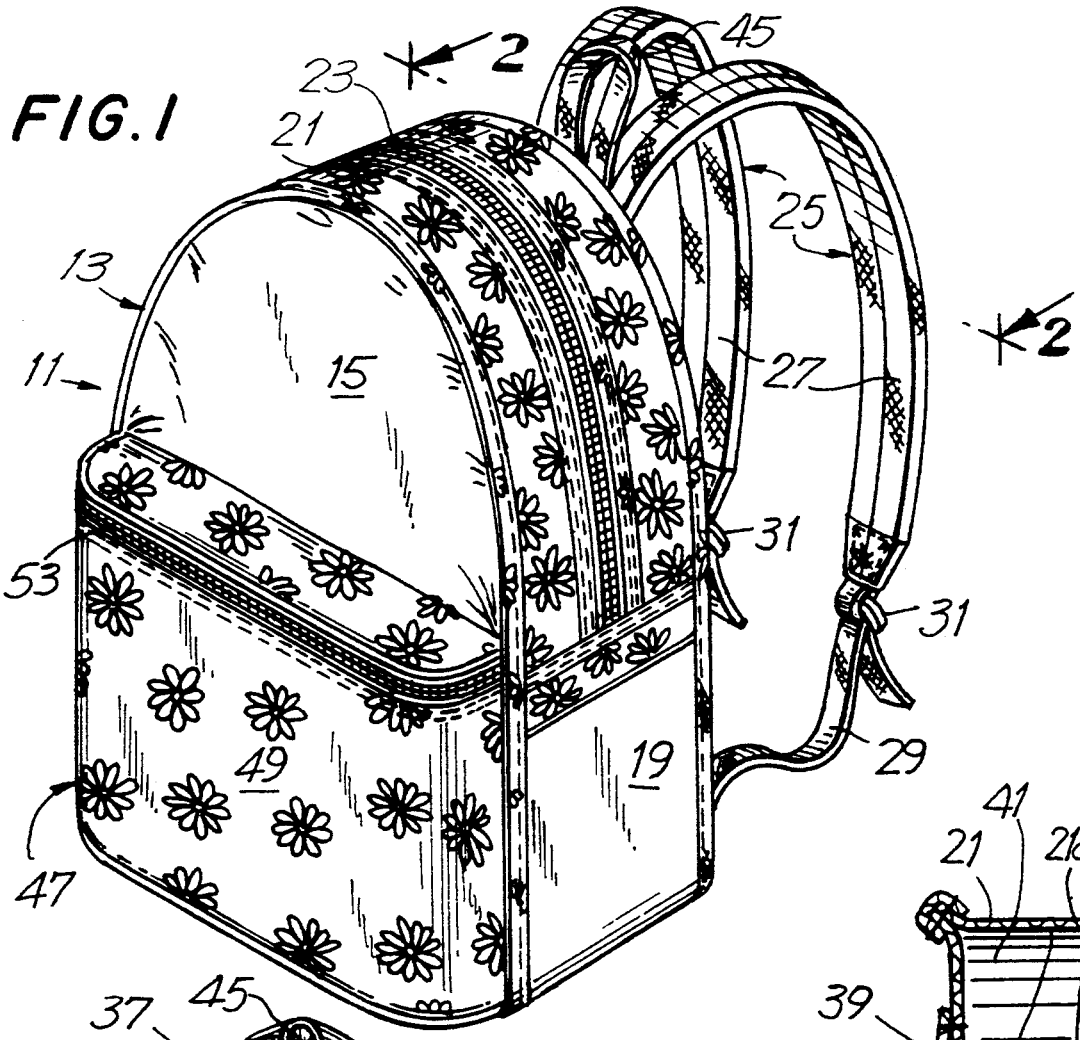
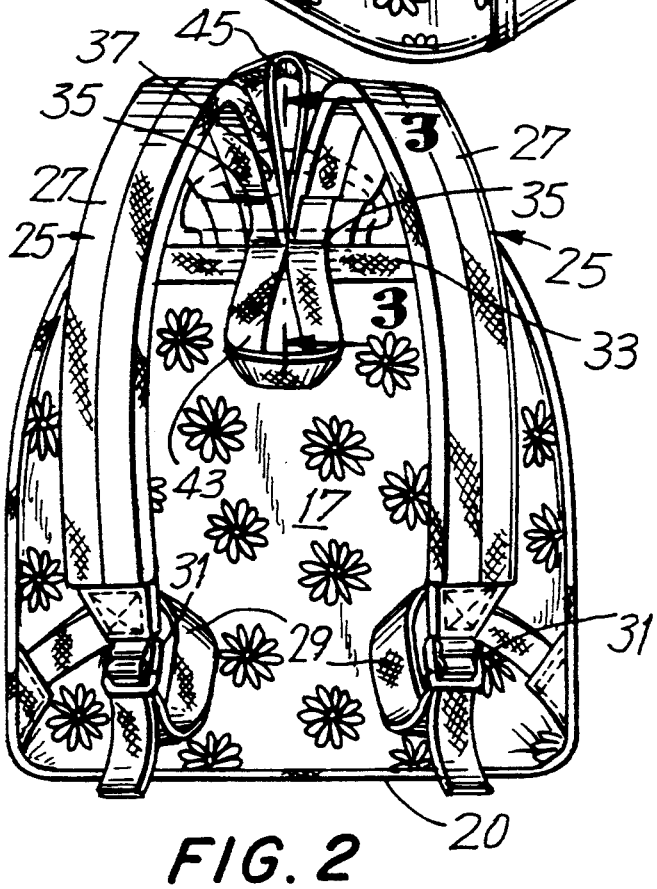
FIG. 2
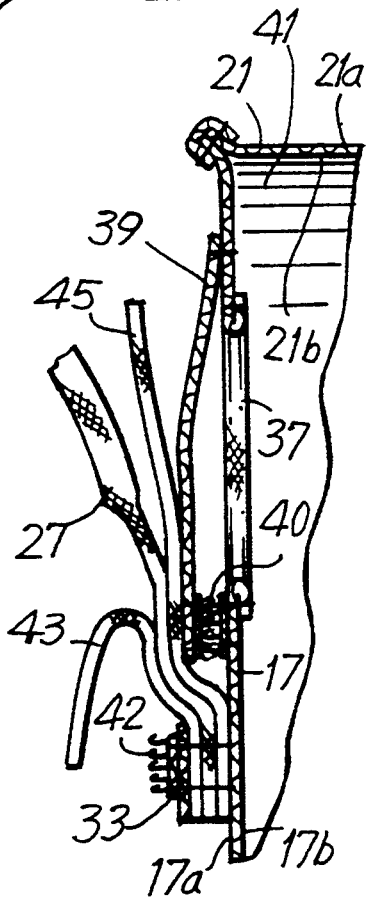
FIG. 3

REVERSIBLE BACKPACK ASSEMBLY

BACKGROUND OF THE INVENTION

This invention relates to a bag and storage assembly, and more particularly, to a backpack assembly that is reversible.

It is well known to reverse bags and related leather goods. For example, in U.S. Pat. No. 4,301,849, a reversible bag is described having a top closure and a reversible zipper. In the '849 the bag includes a pair of handles attached to the outside and a pair of handles attached to the inside. The latter are used when the bag is disposed in a reversed condition.

The problem with the bag of the '849 patent is that the inside handles interfere with storing within and use of the inside of the bag. If the same assembly were used for a backpack, there would be the pair of supporting straps, one on the outside and one on the inside—the latter would also interfere with use of the backpack interior.

Accordingly, it is desirable to provide a reversible backpack assembly which overcomes the above disadvantages.

SUMMARY OF THE INVENTION

Generally speaking, in accordance with the invention, a reversible backpack assembly is provided. The backpack assembly of the invention comprises a bag having an opening to enable access to its interior and a side or rear panel to which a strap assembly is connected. The strap assembly is used by the backpack wearer for carrying the bag along the wearer's back and includes a pair of padded shoulder straps having ends connected to the bag panel and ends which may be selectively coupled to a corresponding pair of strap connectors fixed to the outside and inside of the bag.

In accordance with the invention, there is provided a pair of strap connectors along the outside of the bag and a pair of strap connectors located along the inside of the bag. Each pair of strap connectors may be coupled to the pair of shoulder straps depending upon the condition of the bag. In other words, when the bag is in an unreversed condition, the pair of strap connectors located on the outside of the bag is coupled to the shoulder straps in order to form a strap assembly that is suitable for carrying the bag. On the other hand, if the bag is placed into a reversed condition, as described below, the inside pair of strap connectors may be coupled to the shoulder straps to form a strap assembly suitable for carrying the bag.

In order for the backpack assembly to be reversible, the bag panel is formed with an opening adjacent to where the ends of the pair of shoulder straps are connected. When backpack reversal takes place, the pair of straps is uncoupled from the outside pair of strap connectors and inserted through the opening so that they may be coupled to the inside pair of strap connectors.

Reversal of the backpack member takes place in a conventional fashion. The inside portion of the bag is pushed through the bag opening so that the inside of the bag is exposed and the outside of the bag is located along the interior.

In one embodiment, the backpack assembly will include a pocket disposed along the outside of the bag. The pocket will include a zippered opening to enable access to the pocket interior from outside the backpack assembly. A second zippered opening may optionally be provided for the pocket so that the pocket interior may be reached through the inside of the bag.

When the backpack assembly is placed into a reversed condition, the pocket will now be located within the interior of the bag. Thus, depending on the condition of the backpack assembly (unreversed or reversed), the pocket will either provide for additional storage space when located on the outside of the bag or be hidden from view when located on the inside of the bag.

The panels of the bag that are used in the backpack assembly are made of a single layer of material. Preferably, one side is printed with one type of design and the other side is printed with a different type of design. Thus, the backpack assembly can have a different appearance depending on whether the assembly is in an unreversed or reversed condition.

Accordingly, it is an object of the invention to provide a backpack assembly that is reversible.

Still another object of the invention is to provide a reversible backpack assembly in which the same supporting straps for carrying the backpack may be used when the assembly is in either an unreversed or reversed condition.

Yet a further object of the invention is to provide a reversible backpack assembly having a storage pocket which may be disposed either on the outside or inside of the backpack, depending on whether the assembly is in an unreversed or reversed condition.

Still another object of the invention is to provide a reversible backpack assembly having differing visible designs, depending on whether the assembly is in an unreversed or reversed condition.

Still other objects and advantages of the invention will in part be obvious and will in part be apparent from the following description.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is made to the following description taken in connection with the accompanying drawings, in which:

FIG. 1 is a perspective view of the backpack assembly of the invention in an unreversed condition;

FIG. 2 is a rear elevational view of the backpack assembly shown in FIG. 1;

FIG. 3 is a cross-sectional view taken along line 3—3 of FIG. 2;

DETAILED DESCRIPTION OF THE PREFERRED EMBODIMENTS

Figure 4:
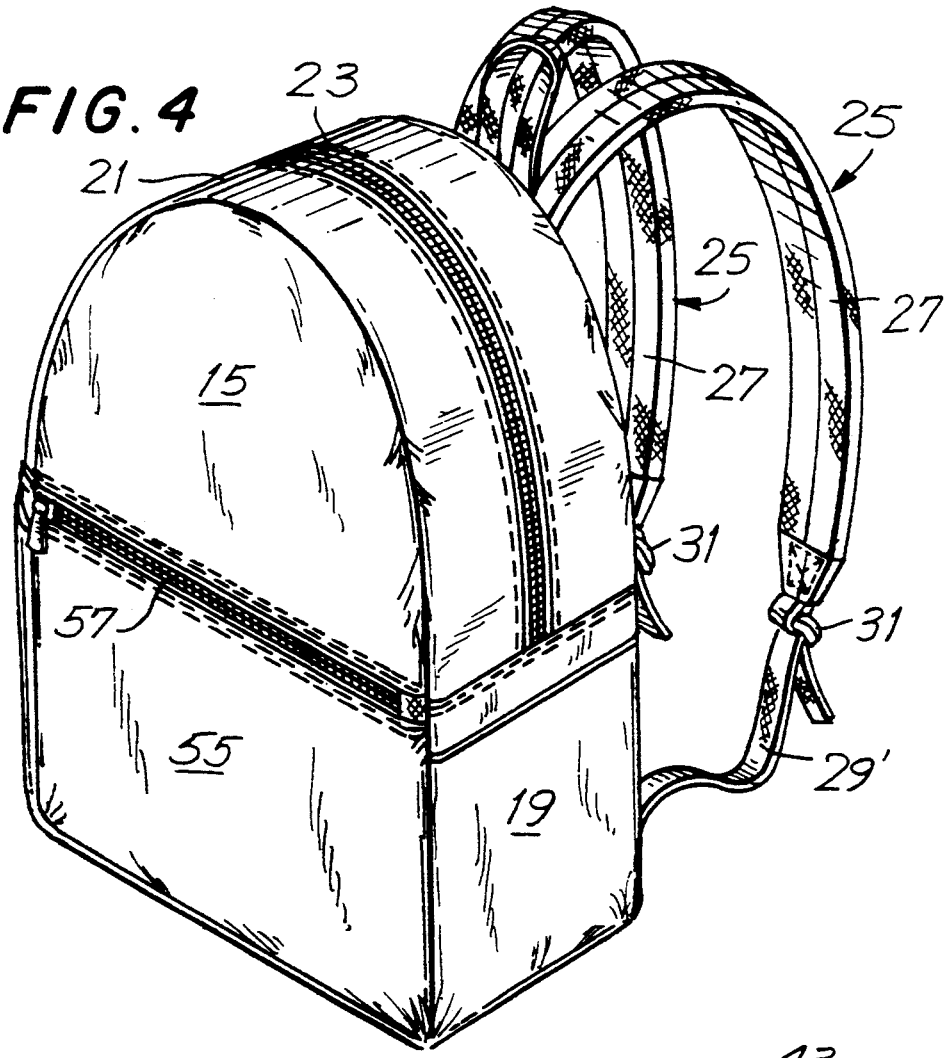
FIG. 4 is a perspective view of the backpack assembly of the invention shown in a reversed condition.

Referring first to FIG. 1, a reversible backpack assembly made in accordance with the invention is generally indicated at 11. Backpack assembly 11 comprises a bag 13 and a pair of strap assemblies generally indicated at 25. Bag 13 is formed from front panel 15, rear panel 17, side panels 19 and bottom panel 20, which together define a bag interior 41. The bag 13 further includes a top portion 21 having an arched configuration that is formed with an extending reversible zipper assembly 23 as is well known in the art. Zipper assembly 23 may be used to selectively form an opening in top portion 21 for enabling access into interior 41 of bag 13.

Strap assemblies 25 of backpack assembly 11 each comprise an upper shoulder strap member 27 and an outside lower strap connector 29 to which upper strap 27 is selectively coupled. Each of upper straps 27 are made of a cushioned or padded fabric material and have a first or upper end 35 that is fixed to the upper portion of rear panel 17. This is achieved by means of a reinforcing strap 33 which extends longitudinally across the upper portion of panel 17, as best shown in FIGS. 2 and 3.

Outside lower strap connectors 29 each have a first end that is fixed to the lower portion of the outside wall of rear panel 17 and a second end which is selectively coupled to the other end of corresponding upper strap 27. While not shown in FIGS. 1–3, assembly 11 also includes a pair of inside lower strap connectors having ends fixed to the lower portion of the inside wall of rear panel 17 and which are used when the assembly is reversed, as described hereinafter.

In the preferred embodiment, the lower ends of upper straps 27 are each formed with a buckle assembly 31, as is well known in the art, and which are used for coupling upper straps 27 to lower strap connectors 29. Buckle assemblies 31 may be used to selectively adjust the length of each of lower strap connectors 29 so that backpack assembly 11 may be fitted to various sized individuals.

As shown best in FIG. 3, backpack assembly 11 further includes a pair of hanging straps 43 and 45 that are fixed to back panel 15 at substantially the same location at which straps 27 of strap assemblies 25 are fixed to panel 15. With greater reference to FIG. 3, it can be seen that each of straps 43, 27 and 45 are correspondingly fixed to panel 27 at the same longitudinal location by means of reinforcing strap 33. Each of hanging straps 43 and 45 may be used for supporting assembly 11 on a hanger or other mounting structure when assembly 11 is not being used.

Turning once again to FIG. 1, backpack assembly 11 also includes a pocket member generally indicated at 47 disposed along and extending from front panel 15. Pocket member 47 is defined by a front panel 49, a top panel 51 and a zipper assembly 53 extending between panels 49 and 51. Operation of zipper assembly 53 enables selective access into a storage interior 63 of pocket member 47. A second zipper assembly (see FIG. 4) may be provided along the inside wall of bag 13 to enable access to pocket interior 47 from bag interior 41.

Turning once again to FIGS. 2 and 3, rear panel 17 is formed with a window or opening 37 located in the upper portion of panel 17 and adjacent to where the ends of upper straps 27 are fixed to panel 17. Opening 37 is selectively closed or covered by a flap 39 pivotally fixed at one end to panel 17 above opening 37. The other end of flap 39 is provided with a Velcro member which can matingly engage with a second Velcro member disposed just below opening 37 (see FIG. 3) to ensure that flap 39 will be maintained in a closed or concealed condition.

In FIGS. 1–3, backpack assembly 11 is shown in an unreversed operating condition. In order to place assembly 11 in a reversed condition, in accordance with the invention, it is first necessary to uncouple shoulder straps 27 from corresponding strap connectors 29. This is achieved by unbuckling the lower ends of straps 27 from the upper ends of strap members 29, as is well known in the art. Then, the lower ends of each of strap 27 are inserted through window or opening 37 formed in panel 17 so that each strap 27 extends substantially into interior 41 of bag 13. Once this step is completed, it is necessary to unzip zippered assembly 20 so that an extending opening is formed along top portion 21. Then, the lower portion of bag 13 is pushed through the opening formed in top member 21 so that assembly 11 achieves an inverted or reversed configuration, as best shown in FIGS. 4 and 5.

Figure 5:
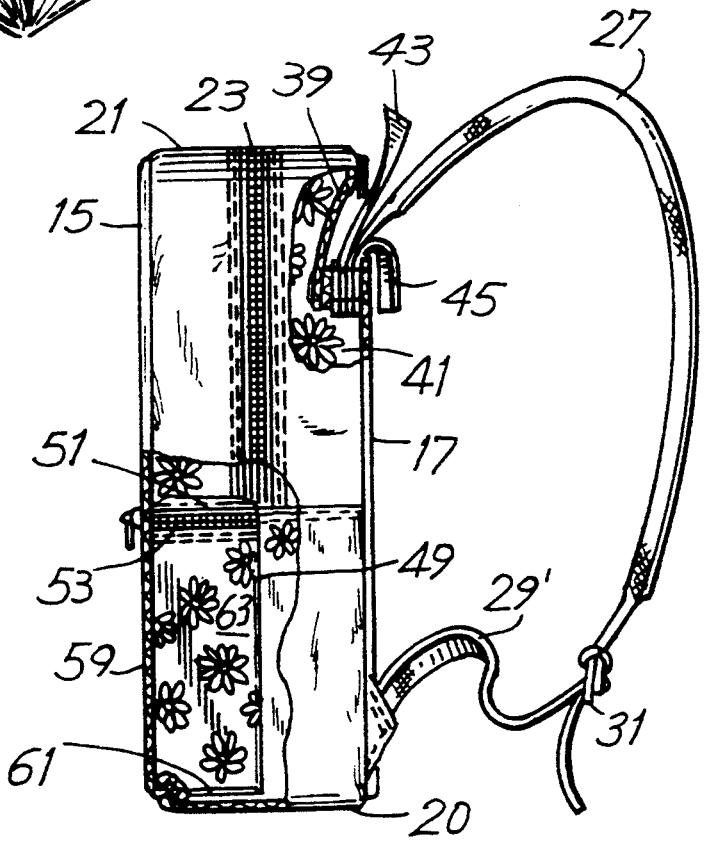
FIG. 5 is a side elevational view in partial cross-section of the reversed backpack assembly shown in FIG. 4.

Continuing with FIGS. 4 and 5, backpack assembly 11 is now shown in reversed operating condition. Straps 27, already inserted or pushed through opening 37, are now coupled to inside strap connectors 29, which now extend from the outside of bag 13. In addition, as the result of inverting backpack assembly 11, pocket member 47 is now disposed inside bag 13, as best shown in FIG. 5. Zipper assembly 53 now enables access into storage interior 63 from bag interior 41, while second zipper assembly 57 is located along the outside of bag 13 and flush with front panel 15 to enable access into storage interior 63 of pocket member 47 from the outside.

If the user later wishes to place the bag in its initial unreversed condition, straps 27 are uncoupled from strap connectors 29 and inserted back through opening 37. Then, zipper assembly 23 of top portion 21 is completely unzipped and the lower portion of assembly 11 is pushed through the opening formed in portion 21, as described hereinabove.

Because backpack assembly 11 is reversible, the user can select from two different designs as to what will appear on the assembly.

One major advantage of the assembly and the mechanism for placing it into a reversed condition is that only a single pair of supporting straps is necessary and in fact used in both unreversed and reversed conditions of the backpack assembly. Therefore, in either condition, there will not be a second pair of supporting straps extending into the storage interior of the backpack bag, which would otherwise interfere with the placement of items and reduce storage capacity.

Another advantage to the backpack assembly of the invention is the use of the pocket. In an unreversed condition, the pocket extends from the outside of the backpack bag, providing additional storage space to the space already provided by the bag. When inverted, the pocket is disposed inside the bag, reducing the overall size of the assembly so that the assembly can be stored in a locker or some other narrow compartment.

Furthermore, the backpack assembly is advantageous since the bag is made of a single composite layer of material, as is shown in FIG. 3. This single layer comprises nylon backed with a PVC material. The nylon side will have one printed design, while the PVC side will have a second design that is visible only when the backpack is reversed.

It will thus be seen that the objects set forth above, among those made apparent from the preceding description, are efficiently attained and, since certain changes may be made in the described product and in the construction set forth above, without departing from the spirit and scope of the invention, it is intended that all matter contained in the above description and shown in the accompanying drawings shall be interpreted as illustrative and not in any limiting sense.

It is also to be understood that the following claims are intended to cover all of the generic and specific features of the invention herein described in all statements of the invention which, as a matter of language, might be said to fall there between.

I claim:

1. A reversible backpack assembly comprising:

a bag having a storage interior, an opening formed therein for access to said interior, and a panel having an outside and an inside;

at least one strap assembly suitable for carrying said bag comprising at least one shoulder strap connected to the outside of said bag panel at a first location, and means for selectively connecting said at least one strap to a second location along the outside of said panel when said assembly is in an unreversed condition;

means for selectively connecting said at least one strap to a location along the inside of said panel;

wherein said panel is formed with an opening adjacent said first location through which said at least one strap is selectively insertible for connection to said inside strap connecting means when said assembly is in a reversed condition.

2. The assembly of claim 1, wherein said outside strap connecting means comprises at least one strap connector fixed to the outside of said panel at said second location and selectively connectable to said at least one strap.

3. The assembly of claim 2, wherein inside strap connecting means comprises at least a second strap connector fixed to said location along the inside of said panel and selectively connectable to said at least one strap.

4. The assembly of claim 3, wherein one of said at least one strap and said at least a one and second strap connector includes a buckle assembly for selectively connecting said strap to said connector.

5. The assembly of claim 4, wherein said at least one strap includes said buckle assembly.

6. The assembly of claim 2, wherein said at least one strap member comprises a pair of straps and wherein said at least one strap connector comprises a pair of strap connectors.

7. The assembly of claim 1, wherein said bag panel has a flap extending therefrom for selectively closing said panel opening.

8. The assembly of claim 1, wherein said bag opening is provided with a zipper assembly for enabling selective access into the interior of said bag.

9. The assembly of claim 1, further including a pocket disposed along the outside of said bag when said bag is in an unreversed condition and within the interior of the bag when the bag is in a reversed condition.

10. The assembly of claim 9, wherein said pocket has a storage interior which supplements the storage interior of the bag when the assembly is in an unreversed condition and subtracts from the storage interior of the bag when the assembly is in a reversed condition.

* * * * *